US005582082A

United States Patent [19]

Gajo

[11] Patent Number: 5,582,082

[45] Date of Patent: Dec. 10, 1996

[54] OPEN-END WRENCH HAVING SELF-CONTAINED RATCHETING MECHANISM ALLOWING ONE-WAY ROTATIONAL DRIVING OF A HARDWARE ELEMENT

[76] Inventor: Alden H. Gajo, 40226 Tesoro La., Palmdale, Calif. 93551

[21] Appl. No.: 513,379

[22] Filed: Aug. 10, 1995

[51] Int. Cl.[6] ..... B25B 13/28

[52] U.S. Cl. ..... 81/111; 81/179

[58] Field of Search ..... 81/111, 126, 125.1, 81/77, 179, DIG. 5

[56] References Cited

U.S. PATENT DOCUMENTS

| | | | |
|---|---|---|---|
| 1,369,459 | 2/1921 | Miskimen | 81/111 |
| 2,618,996 | 11/1952 | Logan | 81/111 |
| 3,198,041 | 8/1965 | Davis | 81/179 |
| 3,803,954 | 4/1974 | Lenker | 81/126 |
| 4,276,790 | 7/1981 | Davis | 81/111 |
| 4,324,159 | 4/1982 | Wrobbel | 81/111 |
| 4,333,366 | 6/1982 | Hurtig | 81/DIG. 5 |
| 4,848,193 | 7/1989 | Wylie, III | 81/111 |

*Primary Examiner*—Bruce M. Kisliuk
*Assistant Examiner*—Joni B. Danganan
*Attorney, Agent, or Firm*—John J. Posta, Jr.

[57] ABSTRACT

An open-end wrench for gripping a hardware element such as a hexagonal nut or the hexagonal head of a bolt is disclosed which allows the wrench to be used for rotational driving of the hardware element in either direction without requiring the wrench to be periodically removed, repositioned, and replaced on the hardware element in order to continue rotation of the hardware element in the desired direction. A retaining member having an opposing jaw is mounted onto a handle having a fixed jaw in a manner whereby the retaining member has simultaneous freedom of movement in both a linear direction and in a rotational direction between first and second positions. When the handle of the wrench is turned in one direction, the nut or the head of the bolt will be rotated, while when the handle of the wrench is turned in the opposite direction, the jaws of the wrench will slip over the nut or the head of the bolt in a ratcheting manner. The wrench may be flipped over to drive the nut or the head of the bolt in the opposite direction.

15 Claims, 2 Drawing Sheets

OPEN-END WRENCH HAVING SELF-CONTAINED RATCHETING MECHANISM ALLOWING ONE-WAY ROTATIONAL DRIVING OF A HARDWARE ELEMENT

BACKGROUND OF THE INVENTION

FIELD OF THE INVENTION

The present invention relates generally to tools for gripping a hardware element, and more particularly to an open-end wrench for gripping a hardware element such as a nut or the head of a bolt, which each typically have a hexagonal configuration, in a manner allowing the wrench to be used for rotational driving of the hardware element in either direction without requiring the wrench to be periodically removed, repositioned, and replaced on the hardware element in order to continue rotation of the hardware element in the desired direction.

Although a wide variety of hand tools are available for just about any conceivable application, there continues to be a demand for improved tools as well as tools offering increased versatility or enhanced ease of use. Nowhere has this been mode evident than in the area of wrenches used to rotate hardware elements such as nuts or the heads of bolts. A wide variety of basic tools has long been available for performing this function, including everything from basic open-end wrenches, box end wrenches, and crescent wrenches to sockets and socket wrenches.

While the more basic wrenches such as open-end wrenches, box end wrenches, and crescent wrenches offer the advantages of being simple, inexpensive, and relatively compact, there is little doubt that sockets and socket wrenches have found favor in use due to the fact that they have a ratcheting mechanism. A ratcheting mechanism allows the socket to be placed on the nut or the head of the bolt only once, with the handle of the socket wrench then being ratcheted back and forth to drive the nut or bolt. Socket sets are more expensive, and have the disadvantage that they may not be used to drive a nut onto an extended length threaded stud, since the socket must be able to fit over both the nut and the portion of the stud that the nut has been screwed onto.

More recently, a number of different alternative tools offering the advantages of a ratcheting mechanism in the embodiment of a simple hand tool have emerged. Such tools include a variety of novelty wrenches professing to be "universal" wrenches which adapt to a range of different size nuts or bolt heads. Such tools generally have a V-shaped receiving member, with an additional member biasing the hexagonal nut or bolt head into the V-shaped receiving member when the handle of the wrench is turned in the proper direction. The mechanism used in such "universal" wrenches is not a true ratcheting mechanism since the angle of the handle with respect to the V-shaped receiving member varies as the tools is used to retain the nut or bolt head within the jaws of the V-shaped receiving member.

In a variation of this concept, one wrench presently known in the art uses a gear mechanism to close jaws similar to those of a crescent wrench as the handle of the wrench is rotated with respect to one side of the jaws. Again, this wrench does not have a true ratcheting mechanism, since the angle of the handle of the tool must be changed twice in each stroke of the tool. This is not a desired operational characteristic, and as might be expected, such tools have never enjoyed widespread popularity.

Another variation on this theme uses a box-end with a driving handle mounted at a ninety degree angle with respect to the box-end jaws. This tool uses a shaft which is rotated to drive a nut or bolt head. Another variation of this tool uses serrated jaws such as those of a pliers instead of the box-end jaws. These tools all have the marked disadvantage that they must be rotated rather than operated by moving the handle from side to side repeatedly. A socket wrench offers the same mode of operation while having a better gripping arrangement for contacting the nut or bolt head.

In fact, the only ratcheting type hand wrench which has ever enjoyed a substantial degree of popularity is the wrench having a built-in ratcheting mechanism which allows a rotating box-end to rotate in a single direction only. Such ratcheting wrenches offer two principal disadvantages. First, by their nature they are box-end wrenches, and thus cannot be constructed as open end wrenches. In addition, while such tools operate quite well, they have a relatively high degree of mechanical complexity, and as such are expensive to manufacture. As such, they have been limited in their use by their necessarily high selling price.

It is accordingly the primary objective of the present invention that a hand wrench be provided which offers the simplicity and advantages of a conventional open-end wrench, but with a ratcheting mode of operation. It is a related objective of the present invention that the ratcheting mechanism of the wrench function in a manner which is independent from the angular position of the handle of the wrench, thereby not depending on a variation of this angular position to grip or release a nut or bolt head as do so-called "universal" wrenches. It is a related objective of the present invention that the ratcheting mechanism of the wrench be of relatively simple mechanical construction, requiring a minimal number of mechanical components for the simplest possible construction.

It is a further objective of the present invention that the mechanical components of the wrench be operable in a manner not requiring a great amount of precise machining of the components to facilitate the ratcheting operation of the wrench. It is still another objective of the present invention that the ratcheting mechanism of the wrench function automatically, without requiring any special procedure to grip a nut or bolt head when the wrench is turned in one direction and to release the nut or bolt head when the wrench is turned in the opposite direction. It is yet another objective of the present invention that the wrench be operable to turn a nut or bolt head in either direction by merely turning the wrench over, rather than requiring any adjustment to the wrench be made to facilitate changing the direction of rotation.

The wrench of the present invention must also be of a mechanical construction which is both durable and long lasting, and it should also require little or no maintenance to be provided by the user throughout the operating lifetime of the wrench. In order to enhance the market appeal of the wrench of the present invention, it should also be of relatively inexpensive construction to thereby afford it the broadest possible market. Finally, it is also an objective that all of the aforesaid advantages and objectives of the present invention be achieved without incurring any substantial relative disadvantage.

SUMMARY OF THE INVENTION

The disadvantages and limitations of the background art discussed above are overcome by the present invention.

With this invention, a hand wrench having only four parts is provided which has a ratcheting mode of operation allowing a nut or bolt head to be driven in either direction by merely turning the wrench over to change the direction of rotation. Only two of the components of the wrench have any substantial degree of mechanical complexity, and neither of these components have precise tolerances requiring a high degree of machining to achieve proper operation of the wrench.

The first principal component of the wrench of the present invention is a handle having a fixed jaw located at one end thereof. The other principal component of the wrench of the present invention is a retaining member having an opposing jaw which is mounted on the handle in a manner whereby the retaining member is moveable between first and second positions with respect to the handle. As the retaining member moves between these two positions with respect to the handle, the opposing jaw of the retaining member moves with respect to the fixed jaw on the handle.

The jaws of the wrench of the present invention will firmly grip a nut or bolt head of a particular size therebetween when the retaining member is in the first position with respect to the handle, and will allow the nut or bolt head to freely rotate when the retaining member is in the second position with respect to the handle. The movement of the retaining member with respect to the handle between the first and second positions is a complex movement involving both movement of the retaining member in a longitudinal direction defined with respect to the handle and movement in a rotational direction by the retaining member with respect to the fixed jaw and the handle. A spring is used to urge the retaining member from the second position into the first position.

The retaining member fits in part over the portion of the handle adjacent the fixed jaw. Movement of the retaining member with respect to the fixed jaw and the handle is both defined and limited to movement between the first and second positions by two factors. First, a pin extending through and retained by the portion of the retaining member fitting over the handle adjacent the fixed jaw is located within a slot in the handle to limit movement of the retaining member in the longitudinal direction. Second, a camming movement caused by the relative interaction between the retaining member on the one hand and the fixed jaw and the handle on the other hand results in the retaining member also moving in a rotational direction with respect to the fixed jaw and the handle whenever the retaining member moves in the longitudinal direction with respect to the handle.

The fixed jaw and the opposing jaw are relatively configured to receive four sides of a hexagonal nut or bolt head therein much like a conventional open-end wrench. The fixed jaw and the opposing jaw will remain in the first position and grip a nut or bolt head therebetween when the handle of the wrench is moved to rotate the nut or bolt head in a first direction. When the wrench is moved in a manner which would tend to rotate the nut or bolt head in the opposite direction, the retaining member will move against the spring from the first position to the second position, allowing the jaws of the wrench to slip freely over the nut or bolt head without driving it in the opposite direction.

Thus, it will be appreciated by those skilled in the art that the wrench has a ratcheting action which will cause it to drive a nut or bolt head in the first direction, but to release the nut or bolt head rather than drive it in the opposite direction. To facilitate driving a nut or bolt head in the opposite direction, the wrench is merely turned over. In the preferred embodiment, the end of the handle opposite the end on which the fixed jaw is mounted may have a conventional open end wrench head.

It may therefore be seen that the present invention teaches a hand wrench which offers the simplicity and advantages of a conventional open-end wrench, but which features a ratcheting mode of operation. The ratcheting mechanism of the wrench of the present invention functions in a manner which is independent from the angular position of the handle of the wrench, thereby not depending on a variation of this angular position to grip or release a nut or bolt head as do so-called "universal" wrenches. In addition, the ratcheting mechanism of the wrench of the present invention is of relatively simple mechanical construction, requiring a minimal number of mechanical components for the simplest possible construction.

The mechanical components of the wrench of the present invention are operable in a manner not requiring a great amount of precise machining of the components to facilitate the ratcheting operation of the wrench. The ratcheting mechanism of the wrench of the present invention functions automatically, without requiring any special procedure to grip a nut or bolt head when the wrench is turned in one direction and to release the nut or bolt head when the wrench is turned in the opposite direction. The wrench of the present invention is operable to turn a nut or bolt head in either direction by merely turning the wrench over, and thus does not require that any adjustment be made to the wrench to facilitate changing the direction of rotation.

The wrench of the present invention is of a mechanical construction which is both durable and long lasting, and which requires little or no maintenance to be provided by the user throughout the operating lifetime of the wrench. The wrench of the present invention is of relatively inexpensive construction in order to enhance its market appeal and to afford it the broadest possible market. Finally, all of the aforesaid advantages and objectives of the wrench of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

The preferred embodiment of the wrench of the present invention includes only two principal components, each of which includes a jaw. One of the jaws is fixed with respect to a wrench handle, while the other jaw is moveable between a first position and a second position in two degrees of mechanical freedom, one of which is linear and the other of which is rotational. A biasing member is used to bias the moveable jaw from the second position into the first position.

Figure 1:
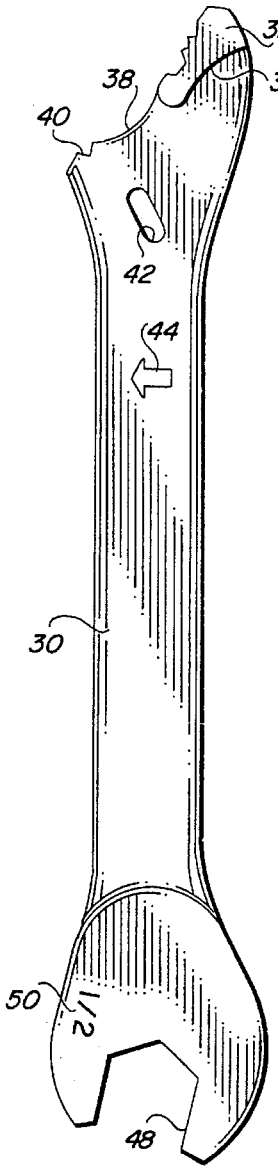
FIG. 1 is a plan view of a wrench handle having a single fixed jaw mounted at a first end thereof, and a conventional open-end wrench mounted at a second end thereof, shown from a first side.
Figure 2:
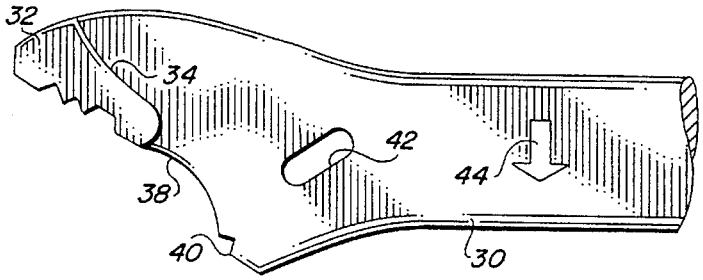
FIG. 2 is an enlarged plan view of the first end of the wrench handle and the single fixed jaw mounted thereon which are illustrated in FIG. 1, shown again from the first side, showing a slot extending through the wrench handle near the first end thereof.
Figure 3:
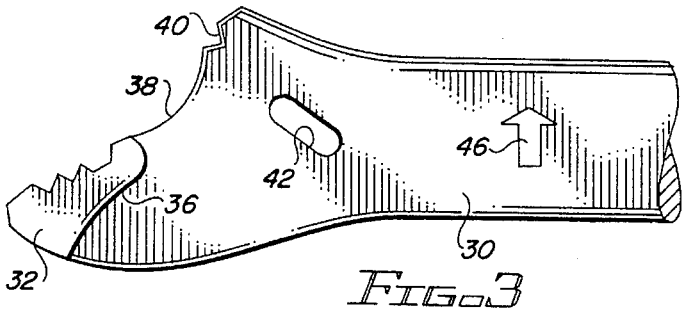
FIG. 3 is an enlarged plan view of the first end of the wrench handle and the single fixed jaw mounted thereon which are illustrated in FIGS. 1 and 2, shown from a second side which is opposite the first side.
Figure 4:
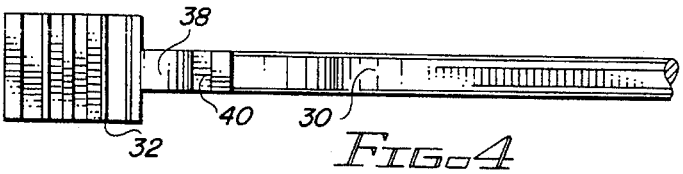
FIG. 4 is a first edge view of the first end of the wrench handle and the single fixed jaw mounted thereon which are illustrated in FIGS. 1 through 3.
Figure 5:
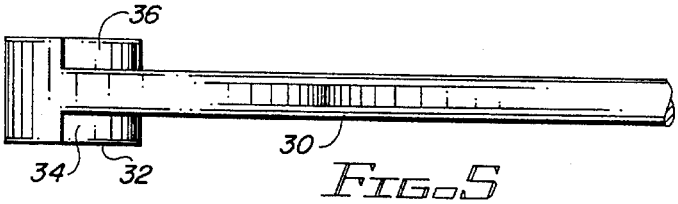
FIG. 5 is a second edge view of the first end of the wrench handle and the single fixed jaw mounted thereon which are illustrated in FIGS. 1 through 4.
Figure 6:
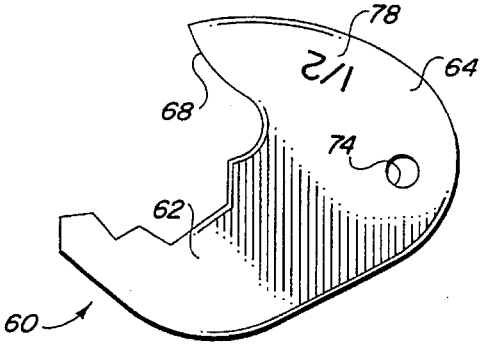
FIG. 6 is a plan view of a retaining member having an opposing jaw, shown from a first side, the retaining member having an aperture extending therethrough.
Figure 7:
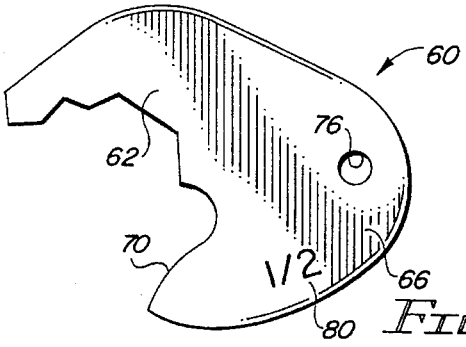
FIG. 7 is a plan view of the retaining member having the opposing jaw which is illustrated in FIG. 6, shown from a second side which is opposite the first side, again showing the aperture extending therethrough.
Figure 8:
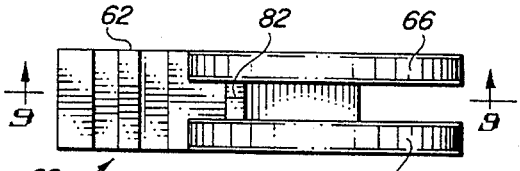
FIG. 8 is an edge view of the retaining member having the opposing jaw which is illustrated in FIGS. 6 and 7, showing spaced-apart first and second flat members extending from the opposing jaw.
Figure 9:
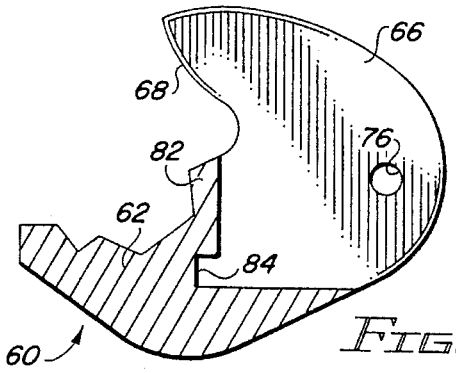
FIG. 9 is a cross-sectional view of the retaining member having the opposing jaw which is illustrated in FIGS. 6 through 8, showing a rib member extending between the first and second flat members adjacent the opposing jaw.

Referring first to FIGS. 1 through 5, a flat wrench handle 30 has a first end illustrated at the top of FIG. 1 and at the left sides of FIGS. 2 through 5, and a second end illustrated at the bottom of FIG. 1. At the first end of the wrench handle 30, the flat surface of the wrench handle 30 extends to a somewhat wider width, and has a fixed jaw 32 located at one side thereof. The fixed jaw 32 is thicker than the wrench handle 30, and extends above the surface of the wrench handle 30 on both sides of the wrench handle 30, as best illustrated in FIGS. 4 and 5.

The sides of the fixed jaw 32 extending above the surface of the wrench handle 30 each have a concave surface configuration as best shown in FIGS. 1 through 3, with the side of the fixed jaw 32 illustrated in FIGS. 1 and 2 being indicated with the reference 34, and the side of the fixed jaw 32 illustrated in FIG. 3 being indicated with the reference numeral 36. Arcs tangential to the concave surfaces 34 and 36 are located at an approximately 45 degree angle with respect to the longitudinal axis of the wrench handle 30. The side of the fixed jaw 32 which will be used to grip a hardware element such as a hexagonal nut or bolt head (not illustrated in FIGS. 1 through 5) has an irregular configuration which is designed to engage one side and part of an adjoining side of a hexagonal nut or bolt head, as will become evident below in conjunction with the description of the operation of the wrench of the present invention.

Centrally located at the first end of the wrench handle 30 adjacent the fixed jaw 32 is a concave surface 38 located in the end of the wrench handle 30. An arc tangential to the concave surface 38 is located at an approximately 45 degree angle with respect to the axis of the wrench handle 30, and parallel to the arcs tangential to the concave surfaces 34 and 36. Located in the end of the wrench handle 30 adjacent the side of the concave surface 38 opposite the fixed jaw 32 is a notch 40, which will be used to receive one end of a biasing member (not shown in FIGS. 1 through 5).

Also located in the wrench handle 30 near the first end thereof just before the flat surface of the wrench handle 30 widens somewhat is a slot 42. The slot 42 extends through the wrench handle 30, and is nearly centrally oriented in the wrench handle 30. The longitudinal direction of the slot 42 is defined by an axis which intersects the arc tangential to the concave surface 38 approximately orthogonally. While the slot 42 will define the linear movement of the moveable jaw (not shown in FIGS. 1 through 5) with respect to the fixed jaw 32, the concave surfaces 34, 36, and 38 will together define the rotational movement of the moveable jaw with respect to the fixed jaw 32.

Located relatively nearer the first end of the fixed jaw 32 than it is near the second end of the wrench handle 30 are two directional indicia 44 and 46, which indicate the direction of movement of the wrench handle 30 in which a ratcheting operation will occur. Accordingly, by moving the wrench handle 30 in the direction of these directional indicia 44 and 46, the wrench will not operate to turn a nut or bolt head (not illustrated in FIGS. 1 through 5). By moving the wrench handle 30 in a direction opposite to these directional indicia 44 and 46, the wrench will operate to turn the nut or bolt head.

Finally, in an optional aspect of the present invention, located at the second end of the wrench handle 30 is a conventional open-end wrench 48. Located on the conventional open-end wrench 48 is an indicium 50 indicating the size of nut or bolt head (not illustrated in FIGS. 1 through 5) which the conventional open-end wrench 48 will engage and drive. In the preferred embodiment, both ends of the wrench of the present invention will engage and drive the same size nut or bolt head. It should be noted that alternately ratcheting mechanisms designed to engage and drive different size nuts or bolt heads could be installed on both ends of the wrench.

Referring next to FIGS. 6 through 9, a retaining member 60 is illustrated which has a opposing jaw 62 having an irregular configuration which is designed to engage two sides and the remaining part of an adjoining side of a hexagonal nut or bolt head, as will become evident below in conjunction with the description of the operation of the wrench of the present invention. Extending from the opposing jaw 62 are two parallel, spaced-apart flat members 64 and 66, which are best shown as being spaced-apart in FIG. 8. One side of the opposing jaw 62 and the first flat member 64 together present a flat face on one side of the retaining member 60, while the other side of the opposing law 62 and the second flat member 66 together present a flat face on the other side of the retaining member 60. The space between the first flat member 64 and the second flat member 66 is designed to freely receive the thickness of the wrench handle 30 (shown in FIG. 4) therein.

The end of the first flat member 64 curved furthest away from the point of connection of the first flat member 64 to the opposing jaw 62 has a convex surface 68 which is of the same configuration and is designed to engage the concave surface 34 of the fixed jaw 32 (shown in FIG. 2). Similarly, the end of the second flat member 66 curved furthest away from the point of connection of the second flat member 66 to the opposing jaw 62 has a convex surface 70 which is of the same configuration and is designed to engage the concave surface 36 of the fixed jaw 32 (shown in FIG. 3).

Extending through the first flat member 64 is an aperture 72, while extending through the second flat member 66 is an aperture 76. The apertures 74 and 76 are coaxial, and will receive a pin (not illustrated in FIGS. 6 through 9) which will also be received in the slot 42 in the wrench handle 30 (shown in FIG. 2). Located on the first flat member 64 and on the second flat member 66 are indicia 78 and 80, respectively, which indicate the size of nut or bolt head (not shown in FIGS. 6 through 9) which the ratcheting open-end wrench of the present invention will engage and drive.

Completing the construction of the retaining member 60 is a thin rib member 82 extending between the first flat member 64 and the first flat member 66, which, together with the opposing jaw 62, defines a notch 84 located within the retaining member 60. The notch 84 will be used to receive the other end of a biasing member (not shown in FIGS. 6 through 9). The edge of the rib member 82 will move adjacent to the concave surface 38 at the first end of the wrench handle 30 (shown in FIG. 2). While the apertures 74 and 76 will define the linear movement of the retaining member 60 with respect to the fixed jaw 32 (also illustrated in FIG. 2), the convex surfaces 68 and 70 together with the rib member 82 will define the rotational movement of the retaining member 60 with respect to the fixed jaw 32.

Figure 10:
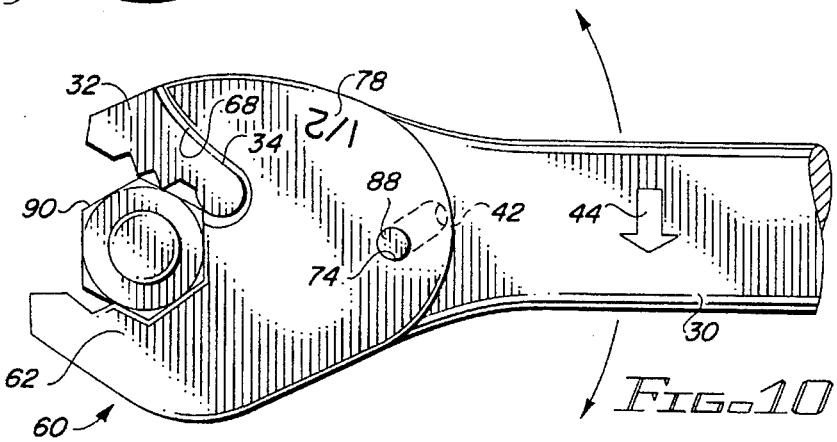
FIG. 10 is a plan view of the retaining member having the opposing jaw which is illustrated in FIGS. 6 through 9 mounted on the first end of the wrench handle adjacent the single fixed jaw mounted thereon which is illustrated in FIGS. 1 through 5, with a pin being installed through the aperture in the retaining member and the slot in the wrench handle, showing a nut retained between the fixed jaw and the opposing jaw.
Figure 11:
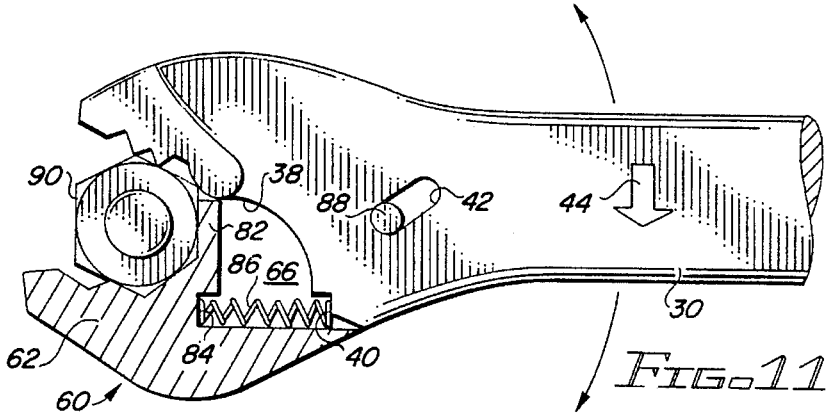
FIG. 11 is a partial cross-sectional plan view of the wrench which is illustrated in FIG. 10, with the retaining member being shown in cross-section to reveal a spring biasing the retaining member into a first position in which the nut is firmly retained and may be driven by the wrench in a counter-clockwise direction with respect to the nut.
Figure 12:
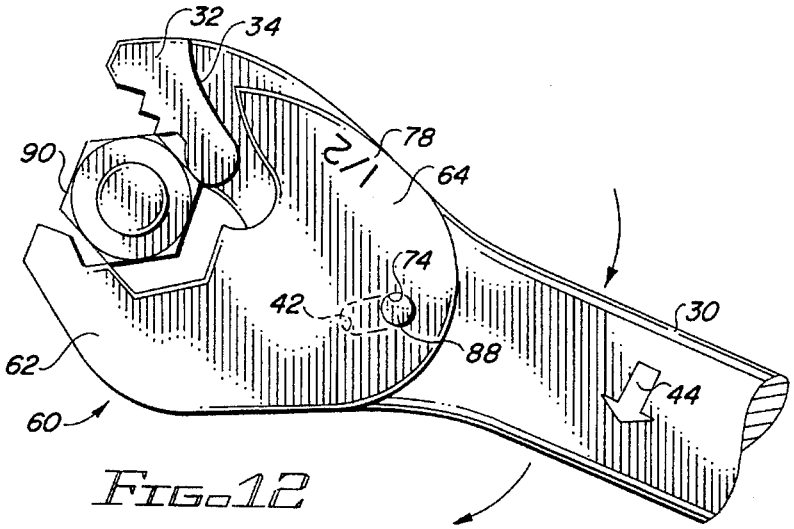
FIG. 12 is a plan view of the wrench which is illustrated in FIGS. 10 and 11, with the wrench being turned in a clockwise direction with respect to the nut, thereby causing the nut to urge the retaining member from the first position illustrated in FIGS. 10 and 11 into a second position in which the fixed jaw and the opposing jaw move apart relative to each other to allow the nut to freely rotate in a counter-clockwise direction with respect to the wrench.

Referring finally to FIGS. 10 through 12, the assembly and operation of the wrench of the present invention are illustrated. The first flat member 64 and the second flat member 66 are placed over the first end of the wrench handle 30 as illustrated, with a biasing spring 86 being located with one end thereof located in the notch 40 in the first end of the wrench handle 30 and the other end thereof located in the notch 84 within the retaining member 60. The convex surface 68 of the first flat member 64 is placed against the concave surface 34 of the fixed jaw 32, and the convex surface 70 of the second flat member 66 is placed against the concave surface 36 of the fixed jaw 32.

The aperture 74 in the first flat member 64 and the aperture 76 in the second flat member 66 of the retaining member 60 are aligned with the slot 42 in the wrench handle 30, and a pin 88 is inserted therein. The ends of the pin 88 are held in the aperture 74 in the first flat member 64 and the aperture 76 in the second flat member 66, respectively, in interference fits, with the pin 88 also extending through the slot 42 in the wrench handle 30.

It will be appreciated by those skilled in the art that the retaining member 60 will move with respect to the wrench handle 30 and the fixed jaw 32 between a first position as shown in FIGS. 10 and 11, and a second position as shown in FIG. 12. In the first position, the pin 88 is located in the slot 42 at the end thereof nearer the first end of the wrench handle 30. In the second position, the pin 88 is located in the slot 42 at the end thereof nearer the second end of the wrench handle 30. During this movement, the convex surface 68 of the retaining member 60 will move against the concave surface 34 of 32, the convex surface 70 of the retaining member 60 will move against the concave surface 36 of the fixed jaw 32, and the end of the rib member 82 will move against the concave surface 38 at the first end of the wrench handle 30.

This movement of the retaining member 60 with respect to the wrench handle 30 and the fixed jaw 32 may be summarized as a linear movement along the longitudinal axis of the slot 42 in the wrench handle 30, along with a simultaneous rotational movement. By nature of the interaction between the retaining member 60 on the one hand and the wrench handle 30 and the fixed jaw 32 on the other hand, these motions must occur simultaneously as the retaining member 60 moves between the first and second positions.

The biasing spring 86 will act to bias the retaining member 60 in a direction from the second position to the first position. As the wrench handle 30 is turned in a counterclockwise position as illustrated in FIGS. 10 and 11, the fixed jaw 32 and the first flat member 66 will together grip four sides of a nut 90 and drive the nut 90 in a counterclockwise direction.

However, if the wrench handle 30 is turned in a clockwise direction as illustrated in FIG. 12, the nut 90 will be allowed to cause the retaining member 60 to move from the first position to the second position, thereby allowing the nut to turn freely within the fixed jaw 32 and the opposing jaw 62, and creating a ratcheting operation with the wrench of the present invention. By turning over the wrench, the nut 90 may be driven in a clockwise direction.

It may therefore be appreciated from the above detailed description of the preferred embodiment of the present invention that it teaches a hand wrench which offers the simplicity and advantages of a conventional open-end wrench, but which features a ratcheting mode of operation. The ratcheting mechanism of the wrench of the present invention functions in a manner which is independent from the angular position of the handle of the wrench, thereby not depending on a variation of this angular position to grip or release a nut or bolt head as do so-called "universal" wrenches. In addition, the ratcheting mechanism of the wrench of the present invention is of relatively simple mechanical construction, requiring a minimal number of mechanical components for the simplest possible construction.

The mechanical components of the wrench of the present invention are operable in a manner not requiring a great amount of precise machining of the components to facilitate the ratcheting operation of the wrench. The ratcheting mechanism of the wrench of the present invention functions automatically, without requiring any special procedure to grip a nut or bolt head when the wrench is turned in one direction and to release the nut or bolt head when the wrench is turned in the opposite direction. The wrench of the present invention is operable to turn a nut or bolt head in either direction by merely turning the wrench over, and thus does not require that any adjustment be made to the wrench to facilitate changing the direction of rotation.

The wrench of the present invention is of a mechanical construction which is both durable and long lasting, and which requires little or no maintenance to be provided by the user throughout the operating lifetime of the wrench. The wrench of the present invention is of relatively inexpensive construction in order to enhance its market appeal and to afford it the broadest possible market. Finally, all of the aforesaid advantages and objectives of the wrench of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A wrench for one-way rotational driving of a hardware element such as a nut or the head of a bolt, said wrench comprising:

a first wrench member comprising a handle having a first end and a second end, and a fixed jaw mounted at said first end of said handle;

a second wrench member comprising an opposing jaw and a pair of spaced-apart flat members extending from one side of said opposing jaw, said spaced-apart flat members for moveable placement at least partially over said handle adjacent said first end of said handle; and means for restricting movement of said second wrench member with respect to said first wrench member between first and second positions, said first and second wrench members being arranged and configured such that movement of said second wrench member with respect to said first wrench member occurs with two degrees of mechanical freedom, one of which degrees of mechanical freedom is linear and the other of which degrees of mechanical freedom is rotational, said fixed and opposing jaws being capable of drivingly engaging the hardware element when said second wrench member is in said first position with respect to said first wrench member and being incapable of drivingly engaging the hardware element when said second wrench member is in said second position with respect to said first wrench member;

wherein when said handle is turned in a first direction with the hardware element located intermediate said fixed and opposing jaws, said second wrench member remains in said first position with respect to said first wrench member and drives the hardware member in said first direction, and wherein when said handle is turned in a second direction opposite to said first direction with the hardware element located intermediate said fixed and opposing jaws, said second wrench member moves from said first position with respect to said first wrench member to said second position with respect to said first wrench member and does not drive said hardware member.

2. A wrench as defined in claim 1, additionally comprising:

means for biasing said second wrench member from said second position with respect to said first wrench member to said first position with respect to said first wrench member.

3. A wrench as defined in claim 2, wherein said biasing means comprises a spring.

4. A wrench as defined in claim 3, wherein said first wrench member additionally comprises:

a first notch located in said first end of said handle at a side thereof which is opposite said fixed jaw;

and wherein said second wrench member additionally comprises:

a second notch located within said second wrench member, whereby a first end of said spring is placed in said first notch and a second end of said spring is placed in said second notch.

5. A wrench as defined in claim 1, additionally comprising:

a conventional open-end wrench located at said second end of said handle.

6. A wrench as defined in claim 1, additionally comprising:

at least one directional indicium located on said handle which indicates the direction of movement of said handle in which a ratcheting operation will occur.

7. A wrench as defined in claim 1, additionally comprising:

at least one indicium located on said wrench which indicates the size hardware element said wrench is designed to drivingly engage.

8. A wrench as defined in claim 1, wherein said handle is flat and is somewhat wider at said first end of said handle, and said fixed jaw is thicker than said handle and extends above the surface of said handle on both sides thereof.

9. A wrench as defined in claim 1, wherein said fixed jaw has an irregular configuration which is designed to engage one side of said hardware element and a corner located between said one side of said hardware element and an adjoining side of said hardware element, and wherein said opposing jaw has an irregular configuration which is designed to engage two sides of said hardware element as well as said adjoining side of said hardware element.

10. A wrench as defined in claim 1, wherein said restricting means comprises:

a slot extending through said handle at a central location adjacent said first end thereof;

an aperture extending through each of said spaced-apart flat members; and a pin mounted in and extending between said apertures in said spaced-apart flat members, said pin extending through said slot in said handle.

11. A wrench as defined in claim 10, wherein said slot is located at approximately a 45 degree angle with respect to a longitudinal axis of said handle.

12. A wrench as defined in claim 1, wherein said restricting means comprises:

a pair of concave surfaces defined by said fixed jaw on respective opposite sides of said handle;

a concave surface located at said first end of said handle;

a convex surface located on each of said spaced-apart flat members which is of the same configuration and is designed to engage one of said concave surfaces defined by said fixed jaw; and a rib member extending between said pair of spaced-apart flat members which is designed to engage said concave surface at said first end of said handle.

13. A wrench as defined in claim 12, wherein arcs tangential to said concave surfaces are all located at approximately 45 degree angles with respect to a longitudinal axis of said handle.

14. A wrench for one-way rotational driving of a hardware element such as a nut or the head of a bolt, said wrench comprising:

a first wrench member comprising a handle having a first end and a second end, and a fixed jaw mounted at said first end of said handle;

a second wrench member comprising an opposing jaw and a pair of spaced-apart flat members extending from one side of said opposing jaw, said spaced-apart flat members for moveable placement at least partially over said handle adjacent said first end of said handle;

means for restricting movement of said second wrench member with respect to said first wrench member between first and second positions, said fixed and opposing jaws being capable of drivingly engaging the hardware element when said second wrench member is in said first position with respect to said first wrench member and being incapable of drivingly engaging the hardware element when said second wrench member is in said second position with respect to said first wrench member, wherein said first and second wrench members are arranged and configured such that movement of said second wrench member with respect to said first wrench member occurs with two degrees of mechanical freedom, one of which is linear and the other of which is rotational; and means for biasing said second wrench member from said second position with respect to said first wrench member to said first position with respect to said first wrench member; wherein when said handle is turned in a first direction with the hardware element located intermediate said fixed and opposing jaws, said second wrench member remains in said first position with respect to said first wrench member and drives the hardware member in said first direction, and wherein when said handle is turned in a second direction opposite to said first direction with the hardware element located intermediate said fixed and opposing jaws, said second wrench member moves from said first position with respect to said first wrench member to said second position with respect to said first wrench member and does not drive said hardware member.

15. A wrench for one-way rotational driving of a hardware element such as a nut or the head of a bolt, said wrench comprising:

a first wrench member comprising a handle having a fixed jaw mounted at one end of said handle;

a second wrench member comprising a pair of spaced-apart flat members extending from one side of an opposing jaw, said spaced-apart flat members for moveable placement on said handle adjacent said one end of said handle; and means for restricting movement of said second wrench member between first and second positions with respect to said first wrench member, said first and second wrench members being arranged and configured such that movement of said second wrench member with respect to said first wrench member occurs with two degrees of mechanical freedom, wherein when said handle is turned in a first direction, said second wrench member remains in said first position and drivingly engages the hardware member, and wherein when said handle is turned in a second direction opposite to said first direction, said second wrench member moves from said first position to said second position and does not drivingly engage said hardware member.

* * * * *